US008640831B2

(12) United States Patent
Talonen

(10) Patent No.: US 8,640,831 B2
(45) Date of Patent: Feb. 4, 2014

(54) METHOD AND ARRANGEMENT FOR MODERNIZING AN ELEVATOR GROUP

(75) Inventor: Tapani Talonen, Tervakoski (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/478,651

(22) Filed: May 23, 2012

(65) Prior Publication Data

US 2012/0255812 A1 Oct. 11, 2012

Related U.S. Application Data

(63) Continuation of application No. PCT/FI2010/050957, filed on Nov. 24, 2010.

(30) Foreign Application Priority Data

Nov. 24, 2009 (FI) ..... 20090442

(51) Int. Cl.
*B66B 1/34* (2006.01)

(52) U.S. Cl.
USPC ..... 187/391; 187/396

(58) Field of Classification Search
USPC ..... 187/247, 248, 380–388, 391–393, 396
See application file for complete search history.

(56) References Cited

U.S. PATENT DOCUMENTS

| | | | | |
|---|---|---|---|---|
| 4,836,336 | A * | 6/1989 | Schroder | 187/384 |
| 4,844,204 | A * | 7/1989 | Ovaska et al. | 187/247 |
| 5,352,857 | A * | 10/1994 | Ovaska | 187/247 |
| 5,357,064 | A | 10/1994 | Boyce et al. | |
| 5,389,748 | A | 2/1995 | Burke et al. | |
| 6,427,807 | B1 * | 8/2002 | Henneau | 187/247 |
| 7,900,750 | B2 * | 3/2011 | Mattsson et al. | 187/247 |
| 7,918,318 | B2 * | 4/2011 | Friedli et al. | 187/247 |
| 8,172,043 | B2 * | 5/2012 | Hughes et al. | 187/382 |
| 2011/0120813 | A1 * | 5/2011 | Flynn et al. | 187/384 |
| 2011/0147134 | A1 * | 6/2011 | Flynn et al. | 187/382 |

FOREIGN PATENT DOCUMENTS

| | | |
|---|---|---|
| WO | WO-2009068725 A1 | 6/2009 |
| WO | WO-2010030290 A1 | 3/2010 |
| WO | WO-2010031753 A1 | 3/2010 |

* cited by examiner

*Primary Examiner* — Anthony Salata
(74) *Attorney, Agent, or Firm* — Harness, Dickey & Pierce, P.L.C.

(57) ABSTRACT

The object of the invention is a method and an arrangement for modernizing an elevator group, in which method the elevators of the elevator group are modernized in turn such that both modernized elevators and unmodernized elevators can be simultaneously in use in the elevator group, of which elevators the modernized elevators are each provided with individualized identification marks while the old unmodernized elevators in use in the elevator group are each provided with a similar identification mark to each other.

19 Claims, 2 Drawing Sheets

METHOD AND ARRANGEMENT FOR MODERNIZING AN ELEVATOR GROUP

CROSS REFERENCE TO RELATED APPLICATIONS

This application is a continuation of International Application Number PCT/FI2010/050957 filed on Nov. 24, 2010 and claims priority to Finish Application Number 20090442 filed on Nov. 24, 2009, the entire contents of each of which are hereby incorporated herein by reference.

FIELD

The object of the invention is a method and an arrangement for modernizing an elevator group, in which elevator group both unmodernized old elevators based on a collective control system and modernized new elevators based on a destination control system can be simultaneously in operation.

BACKGROUND

Modernization-time solutions are known in the art wherein e.g. an elevator's own old call pushbuttons are left on the floor levels, which pushbuttons comprise only a button for a call upwards and a button for a call downwards while destination call panels are installed on the same floor levels for modernized elevators, with which destination call panels the desired destination floor can be directly given already on the call floor. In this case a problem is that a passenger must make a choice on the floor level as to the elevator of which control method he/she wants to take. In this case the passenger might use both the call pushbuttons of old elevators and the destination call panels of new elevators, in which case both an old and a new elevator can arrive at the floor level essentially simultaneously. Solutions are also known in which the old call pushbuttons are replaced with new destination call panels, with which it is possible to give calls to both unmodernized and modernized elevators. A problem forms in this case in how the user can be reliably guided to either the new or the old elevator or elevator group serving him/her. One known solution is to provide the elevators with identification marks, e.g. with a letter sequence A, B . . . H or with a number sequence 1, 2 . . . 8 and to guide the user to go e.g. to the elevators "E-H" or "5-8", if the user is served with a group consisting of unmodernized elevators that includes in this example case the elevators E, F, G and H (or 5, 6, 7 and 8). A problem in these solutions is that it is difficult for a user to remember the content of the guidance. After a while the user will perhaps not remember whether the guidance was to the elevators "C-F" or "D-G", or "3-8" or "4-8". In this case it is generally also difficult for the user to piece together where all the elevators related to the guidance are situated.

Yet another solution used in the modernization phase is of the type that the user is guided verbally to go to an old elevator, e.g. as follows: "Mene vanhalle hissille" or "Go to Old/Existing Elevator". A problem in this case is that it might be difficult for a user to identify which elevators of an elevator group are old and which are new. This can occur particularly if the entrances of the elevator cars are not renewed and the old landing doors are used.

SUMMARY

The aim of this invention is to eliminate the aforementioned drawbacks and to achieve a simple and inexpensive solution for modernizing an elevator group, which solution enables the flexible simultaneous use of the old and the new elevators during the modernization phase. Another aim of the invention is to achieve a solution that enables passengers to easily find the correct elevator during the modernization phase of the elevators.

Example embodiments provide methods and elevator arrangements. Other embodiments of the invention are characterized by what is disclosed herein. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment of the invention can also be applied in other embodiments. In addition, it can be stated that at least some of the subordinate claims can in at least some situations be deemed to be inventive in their own right.

One advantage of the solution according to the invention is that it is easy for passengers to use both the old and the new elevators in the elevator group during the modernization phase. A further advantage is that the solution according to the invention is simple and inexpensive to implement, and is also clear to use. A new destination call panel on a floor level can be used normally to call both new and old elevators and the guidance for an old and for a new elevator does not essentially differ from each other. A user experiences the guidance as essentially similar whether it is guidance to an old elevator or guidance to a new elevator. Another advantage is that as the modernization phase progresses it is not necessary to make essential modifications to the old elevators. The only visible change is the giving of an identification mark to each elevator and when the elevator has been modernized the identification mark is simply changed to a sequence suiting the identification marks of the modernized elevators.

BRIEF DESCRIPTION OF THE DRAWINGS

In the following, the invention will be described in more detail by the aid of some embodiment examples with reference to the attached drawings, where.

DETAILED DESCRIPTION

Figure 1:
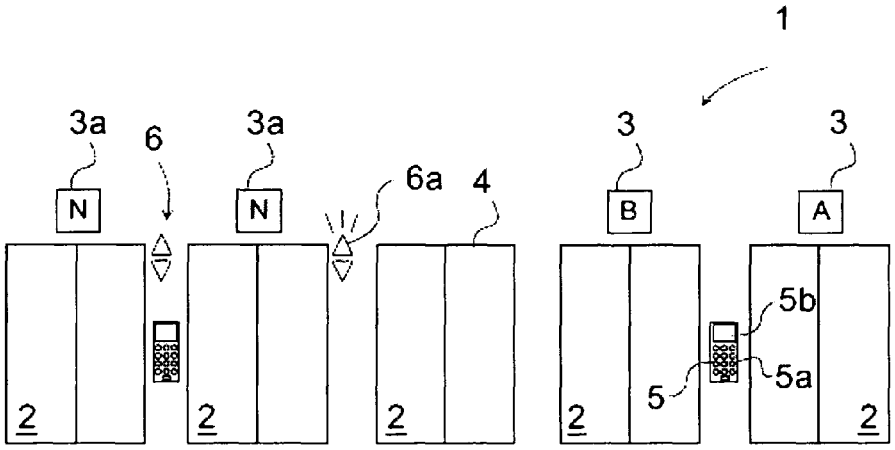
FIG. 1 presents a front view of one elevator group in the modernization phase on one floor level.

FIG. 1 presents a front view of one elevator group 1 that is in the modernization phase, which elevator group comprises five elevators, which are described by the doors 2 of the floor level. All the elevators in use are marked in connection with the door 2 of the floor level, e.g. with an identification mark above the door, which identification mark is in each modernized elevator an individual identification mark 3 and in the old unmodernized elevators the same identification mark 3*a* in all that differs from the identification marks 3 of the modernized elevators. It is seen from FIG. 1 that the elevator group 1 contains two modernized elevators based on a Destination Control System (DCS), the identification marks 3 of which are A and B, as well as two old elevators based on collective control, the identification mark 3*a* of both of which is N. Additionally, the elevator group comprises one elevator 4 that is in the modernization phase, which elevator is not right now in use owing to the modernization work and which elevator does not comprise an identification mark 3 or 3*a* nor a direction indicator 6.

The old call pushbuttons intended for up-calls and down-calls of the collective control are removed from each floor level at the beginning of modernization and one or more new destination call panels 5 are disposed in place of the old call buttons. In addition, the direction indicators 6 that have been in use are left in connection with the doors 2 that are in use by the old elevators N, so that passengers may know which is the correct arriving elevator for his/her call. The direction indicators 6 of each elevator that are on the floor levels are removed only when the elevator is in the modernization phase.

The solution according to the invention is characterized in that both the old unmodernized elevators N in use and also the new, already modernized, elevators A and B receive their calls only from destination call panels 5. In the situation according to FIG. 1 a passenger wanted to go upwards from the floor level in question and pressed the destination button 5*a* or symbol of the floor he/she wants on the destination call panel 5. The call went to the group control of the elevator, in which a special actuator decided that the most suitable elevator for the purpose to be sent to the floor level is the second of the old unmodernized elevators, the identification mark of which is N. In this case the letter "N" is shown on the display 5*b* of the destination call panel 5 as guidance information for the passenger. The display of a destination call panel can also contain other guidance information, such as e.g. an indicator showing direction, illustrating in which direction the elevator in question is with respect to the destination call panel. Additionally, if there are still many old elevators marked with the identification mark N, the upward-indicating direction indicator 6*a* of the elevator coming to the called floor level is illuminated. Thus it is easy for the passenger to find the elevator N coming to the floor level that is correct for him/her.

In an old elevator N the passenger must still press the destination floor button of the car panel that is in the elevator car in order to be able to go to the floor he/she originally wanted. If he/she had gone into a new elevator A or B, the new elevator would have taken him/her directly to the floor that he/she had selected on the destination call panel 5 when calling the elevator. The elevator cars of the new elevators do not contain car panels guiding to the floors, so that it is no longer possible there to select the floor to which to go.

Figure 2:
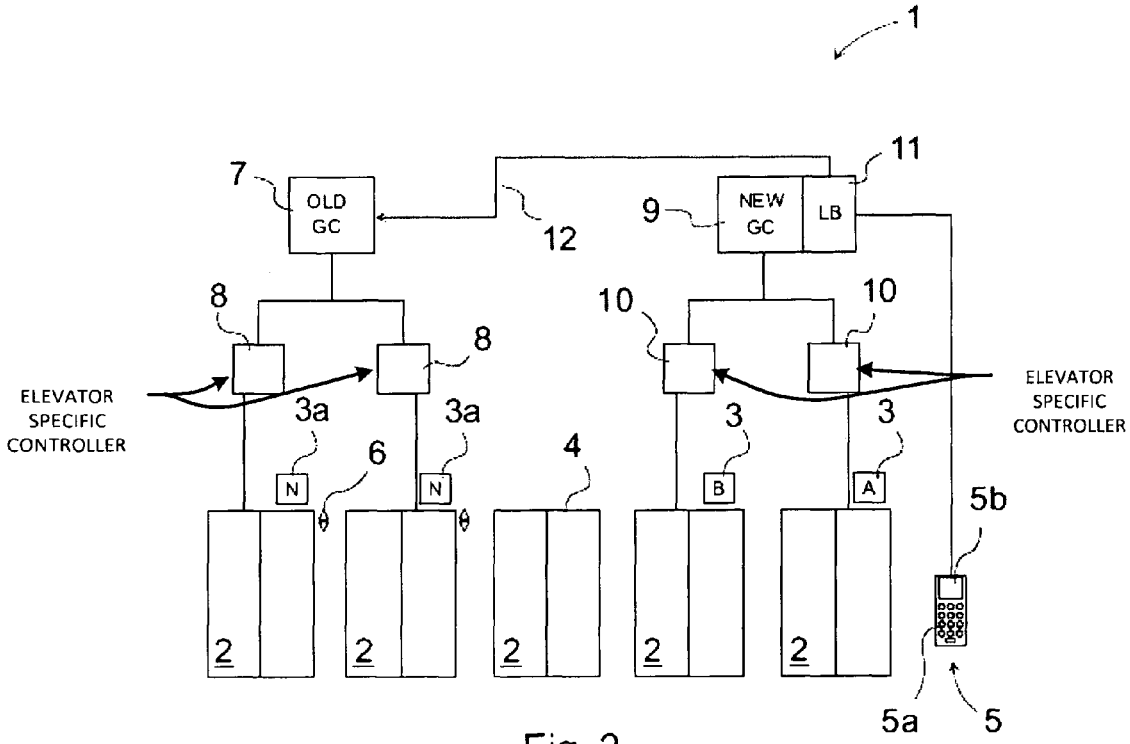
FIG. 2 presents an elevator group according to FIG. 1 and diagrammatically the control of same.

FIG. 2 presents the same elevator group 1 in the same modernization phase as in FIG. 1. In addition, FIG. 2 presents the control arrangement of the elevator group 1. For the old elevators N, the elevator group 1 still in the modernization phase comprises an old group control 7 based on the collective control principle as well as elevator-specific control means 8, which operate still in essentially the same manner as before the commencement of modernization. In addition, a new group control 9 based on destination control, as well as elevator-specific control means 10, have been installed in the elevator group 1 for the new, already modernized, elevators A and B. The elevator group 1 is thus formed, in fact, from two subgroups, of which the unmodernized elevators operating under the control of the old group control form one subgroup and the modernized elevators operating under the control of the new group control form the other subgroup. An actuator 11 is also in connection with the new group control 9, which actuator receives and distributes calls given from a destination call panel between the new group control 9 and the old group control 7 on the basis of some desired division criterion, e.g. a criterion that optimizes the transport capacity of the subgroups. If on the basis of the division criterion a passenger who has given a call will be served by some unmodernized elevator, the actuator 11 sends either an up-call or a down-call to the old group control. The new group control 9 with actuator 11 and destination call panel(s) 5 is fitted to operate such that after a passenger has pressed in the destination call panel 5 a button, pushbutton or point on a touch-sensitive screen that refers to a floor higher than the call floor, the actuator 11 deduces that the passenger wants to go upwards, in which case the call to be sent to the old group control 7 is an up-call corresponding to the call floor. Correspondingly, after a passenger has pressed in the destination call panel 5 a button, pushbutton or point on a touch-sensitive screen that refers to a floor lower than the call floor, the actuator 11 deduces that the passenger wants to go downwards, in which case the call to be sent to the old group control is a down-call. The aforementioned up-call or down-call is transmitted to the old group control via a signal connection 12. As a result of the call the old group control sends any of the unmodernized elevators to the call floor and at the same time "N" appears on the display of the destination call panel for guiding the passenger who gave the call to the old elevators, and also the direction indicator 6 (up-arrow or down-arrow) of the elevator in question is controlled on (illuminated). If the actuator 11 decides that the passenger will be served with modernized elevators, the destination call data (call floor and destination floor) are conveyed to the new group control 9. On the basis of the call data the new group control sends a modernized elevator A or B for the use of the passenger, the identification mark of which elevator is indicated on the display 5*b* of the destination call panel. In the solution according to FIG. 2 the actuator 11 is integrated into connection with the new group control 9 but it is obvious to the person skilled in the art that it can also be implemented as a separate unit, which is connected to both the old and to the new group control using a signal connection suited to the purpose.

Figure 3:
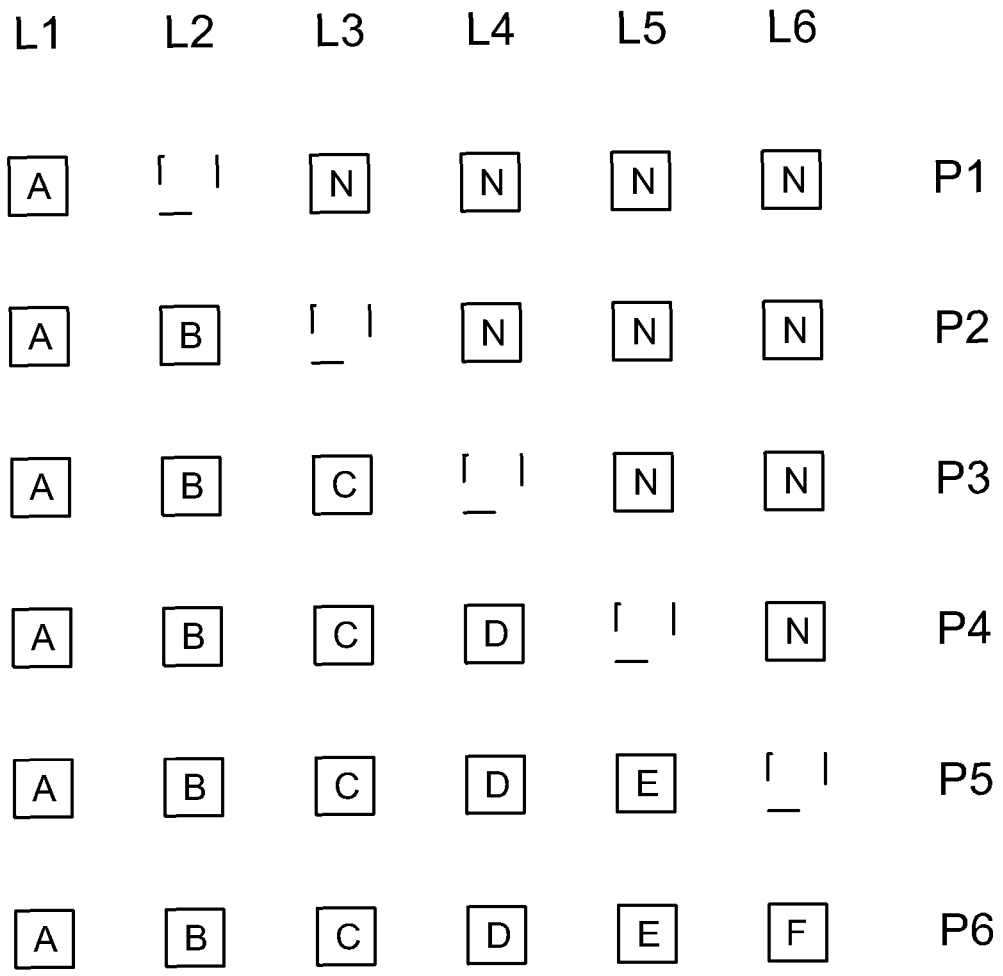
FIG. 3 presents a simplified and diagrammatic view of the different phases of the solution according to the invention.

FIG. 3 presents a diagrammatic view of the different phases of the solution according to the invention. Deviating from the earlier figures, at issue here is an elevator group of six elevators L1-L6. The topmost row of identification marks formed from the squares presents one starting phase P1 of the modernization of an elevator group, which phase has progressed so far that the first elevator L1 is already modernized and connected to the new group control 9 and, that being the case, is operating as destination-controlled. Correspondingly, the second elevator L2 is currently to be modernized and not in use. The other elevators L3-L6 still operate under the control of the old group control 8. The identification mark A has been given to the modernized elevator L1 and a common identification mark N has been given to each of the old elevators that are in use.

In the next phase P2 the elevators L1 and L2 are modernized and they operate as destination-controlled under the control of the new group control. The elevator L2 has received the identification mark B. Correspondingly, the elevator L3 is out of use in this modernization phase and the elevators L4-L6 are operating normally as old elevators under the control of the old group control, as stated above. It is proceeded thus from phase to phase until all the elevators L1-L6 have been modernized and each has been given its own identification mark from the letter sequence A-F. After this the old group control 7 is removed from use and the whole elevator group 1 functions under the control of the new group control 9 as destination-controlled.

The identification marks 3, 3*a* are e.g. easily changeable signboards or they are e.g. on display means disposed above the elevator doors, in which display means the identification marks to be expressed can be changed under the control of commands sent by the new group control or some other control, or directly manually e.g. by changing the switch data to be connected to the display means.

It is obvious to the person skilled in the art that the invention is not limited solely to the examples described above, but that it may be varied within the scope of the claims presented below. Thus, for example, numbers or different marks can be used as identification marks instead of letters. The letters and numbers are generally in consecutive sequence, i.e. A, B, C, . . . , N or 1, 2, 3, etc.

It is also obvious to the person skilled in the art that instead of the separate identification mark N of an unmodernized elevator, the identification coming to the last elevator to be modernized can already be used as the identification mark of an unmodernized elevator. In this case, one advantage is that when modernizing the last elevator, a new identification mark does not need to be given to it.

It is further obvious to the person skilled in the art that the various phases of the modernization method to be performed in the arrangement can be in a different sequence to each other than what is described above

The invention claimed is:

1. A method for modernizing an elevator group, the method comprising:

modernizing elevators of the elevator group such that both modernized elevators and unmodernized elevators are usable simultaneously in the elevator group; wherein each of the modernized elevators is provided with an individualized identifier, and each of the unmodernized elevators is provided with an identical identifier.

2. The method according to claim 1, wherein the identifier provided to the unmodernized elevators is different from the individualized identifiers provided to the modernized elevators.

3. The method according to claim 1, wherein call buttons intended for up-calls and down-calls are replaced with a destination call panel on at least one floor level, and destination calls provided from the destination call panel are distributed based on division criterion between an old group controller controlling the unmodernized elevators and a new group controller controlling the modernized elevators.

4. The method according to claim 3, wherein a destination call received from the destination call panel is sent to the old group controller controlling the unmodernized elevators as an up-call or a down-call based on a travel direction associated with the destination call.

5. The method according to claim 1, wherein passengers are guided in a same manner to both the modernized elevators and the unmodernized elevators by notifying each passenger of the identifier of the elevator serving the passengers and a possible location or other guidance information associated with the elevator.

6. The method according to claim 1, wherein an indication that an unmodernized elevator is coming to the call floor is provided to passengers by direction indicators connected to the unmodernized elevators.

7. The method according to claim 1, further comprising:

removing direction indicators of each elevator that are on the floor levels when the elevator is in the modernization phase.

8. An arrangement to modernize an elevator group including a plurality of elevators, the arrangement comprising:

a first group control configured to control modernized elevators of the elevator group;

a second group control connected to the first group control, the second group control being configured to control unmodernized elevators of the elevator group;

wherein the plurality of elevators are configured to be modernized in turn such that both the modernized and the unmodernized elevators among the plurality of elevators are usable at least one of concurrently and simultaneously, wherein each modernized elevator is provided with an individualized identifier, and wherein each of the unmodernized elevators is provided with an identical identifier.

9. The arrangement according to claim 8, wherein the individualized identifier provided to a last modernized elevator is the same as the identifier provided to the unmodernized elevators.

10. The arrangement according to claim 8, further comprising:

a destination call panel on at least one floor level; and an actuator connected to the destination call panel, the actuator being configured to receive and distribute destination calls from the destination call panel based on division criterion between the first group control and the second group control.

11. The arrangement according to claim 10, wherein the actuator is configured to send destination calls from the destination call panel to the second group control as an up-call a down-call based on the travel direction indicated by the destination call.

12. The arrangement according to claim 10, wherein the actuator is integrated with the first group control.

13. The arrangement according to claim 8, wherein the arrangement is configured to guide passengers to the modernized elevators and the unmodernized elevators by notifying each passenger of the identifier of a serving elevator and possible location or other guidance information associated with the serving elevator.

14. The arrangement according to claim 8, wherein the unmodernized elevators include direction indicators configured to indicate to passengers which of the unmodernized elevators is arriving at the call floor.

15. The arrangement according to claim 14, wherein the direction indicators of each elevator on floor levels are removed during the modernization phase of the elevator.

16. The arrangement of claim 8, further comprising:

a destination call panel configured to send elevator calls to the first and second group controls; wherein each of the modernized and unmodernized elevators receives destination calls from the destination call panel.

17. The arrangement according to claim 8, wherein the identifier provided to the unmodernized elevators is the same as the individualized identifier provided to a last elevator to be modernized.

18. The method according to claim 1, wherein the identifier provided to the unmodernized elevators is the same as the individualized identifier provided to a last elevator to be modernized.

19. A method for modernizing an elevator group, the method comprising:

modernizing each of a plurality of unmodernized elevators in the elevator group, the plurality of unmodernized elevators having an identical identifier; and, assigning each of the modernized elevators a unique identifier identifying each modernized elevator in the elevator group; wherein both modernized elevators and unmodernized elevators are usable at least one of concurrently and simultaneously.

* * * * *